US007641598B2

(12) United States Patent
Rodgers, Jr.

(10) Patent No.: US 7,641,598 B2
(45) Date of Patent: Jan. 5, 2010

(54) TRANSLATING SUPPORT ASSEMBLY SYSTEMS AND METHODS FOR USE THEREOF

(76) Inventor: Robert E. Rodgers, Jr., 974 Kings Point Dr., Canyon Lake, TX (US) 78133

( * ) Notice: Subject to any disclaimer, the term of this patent is extended or adjusted under 35 U.S.C. 154(b) by 0 days.

(21) Appl. No.: 11/681,045

(22) Filed: Mar. 1, 2007

(65) Prior Publication Data

US 2007/0219062 A1 Sep. 20, 2007

Related U.S. Application Data

(60) Provisional application No. 60/780,599, filed on Mar. 9, 2006, provisional application No. 60/881,205, filed on Jan. 18, 2007.

(51) Int. Cl.
*A63B 22/00* (2006.01)
*A63B 22/06* (2006.01)

(52) U.S. Cl. ..... 482/52; 482/57

(58) Field of Classification Search ..... 482/51–53, 482/57, 66, 70, 71, 62, 79, 80
See application file for complete search history.

(56) References Cited

U.S. PATENT DOCUMENTS 1,166,304 A 12/1915 Albert
3,756,595 A * 9/1973 Hague ..... 482/51
4,869,496 A * 9/1989 Colombo ..... 482/71
4,940,233 A 7/1990 Bull et al.
5,611,756 A 3/1997 Miller
5,735,773 A 4/1998 Vittone et al.
5,795,268 A 8/1998 Husted
5,910,072 A 6/1999 Rawls et al.
5,967,944 A 10/1999 Vittone et al.
5,989,163 A 11/1999 Rodgers, Jr.
6,004,244 A 12/1999 Simonson
6,036,622 A 3/2000 Gordon
6,045,487 A 4/2000 Miller
6,113,518 A 9/2000 Maresh et al.
6,123,650 A * 9/2000 Birrell ..... 482/70
6,152,859 A 11/2000 Stearns (Continued)

OTHER PUBLICATIONS

U.S. Appl. No. 60/780,599, filed Mar. 9, 2006, Rodgers.

(Continued)

*Primary Examiner*—Loan H Thanh
*Assistant Examiner*—Daniel F Roland
(74) *Attorney, Agent, or Firm*—Fulbright & Jaworski L.L.P.

(57) ABSTRACT

An exercise apparatus comprises: a frame; a crank system comprising first and second crank coupling locations, the crank system being supported by the frame; a right foot support member comprising a first right guide element; a left foot support member comprising a first left guide element; a right movable member comprising a second right guide element; a left movable member comprising a second left guide element; a first flexible support system comprising a first flexible element, the first flexible element coupled to the frame and the first and second right guide elements and operative to move the first crank coupling location when the right foot support member moves; and a second flexible support system comprising a second flexible element, the second flexible element coupled to the frame and the first and second left guide elements and operative to move the second crank coupling location when the left foot support member moves.

35 Claims, 6 Drawing Sheets

U.S. PATENT DOCUMENTS

| | | | | |
|---|---|---|---|---|
| 6,165,107 | A * | 12/2000 | Birrell | 482/70 |
| 6,340,340 | B1 * | 1/2002 | Stearns et al. | 482/52 |
| 6,579,210 | B1 | 6/2003 | Stearns et al. | |
| 6,626,802 | B1 | 9/2003 | Rodgers, Jr. | |
| 6,689,019 | B2 | 2/2004 | Ohrt et al. | |
| 6,726,600 | B2 * | 4/2004 | Miller | 482/51 |
| 6,761,665 | B2 | 7/2004 | Nguyen | |
| 6,926,646 | B1 | 8/2005 | Nguyen | |
| 7,217,225 | B2 * | 5/2007 | Husted et al. | 482/51 |
| 7,244,217 | B2 * | 7/2007 | Rodgers, Jr. | 482/52 |
| 2001/0012811 | A1 * | 8/2001 | Gordon | 482/70 |
| 2002/0094914 | A1 * | 7/2002 | Maresh et al. | 482/51 |
| 2004/0058784 | A1 * | 3/2004 | Roberts, Jr. | 482/52 |
| 2004/0077463 | A1 * | 4/2004 | Rodgers, Jr. | 482/52 |
| 2004/0235621 | A1 * | 11/2004 | Eschenbach | 482/52 |
| 2004/0248704 | A1 * | 12/2004 | Rodgers, Jr. | 482/83 |
| 2004/0248705 | A1 * | 12/2004 | Rodgers, Jr. | 482/83 |
| 2004/0248706 | A1 * | 12/2004 | Rodgers, Jr. | 482/83 |
| 2004/0248707 | A1 * | 12/2004 | Rodgers, Jr. | 482/83 |
| 2004/0248708 | A1 * | 12/2004 | Rodgers, Jr. | 482/83 |
| 2004/0248709 | A1 * | 12/2004 | Rodgers, Jr. | 482/83 |
| 2004/0248710 | A1 * | 12/2004 | Rodgers, Jr. | 482/86 |
| 2005/0043148 | A1 * | 2/2005 | Maresh | 482/70 |
| 2005/0049117 | A1 | 3/2005 | Rodgers, Jr. | |
| 2005/0124466 | A1 | 6/2005 | Rodgers, Jr. | |
| 2005/0124467 | A1 | 6/2005 | Rodgers, Jr. | |
| 2005/0272562 | A1 * | 12/2005 | Alessandri et al. | 482/52 |
| 2006/0003868 | A1 * | 1/2006 | Lull et al. | 482/52 |
| 2006/0199702 | A1 * | 9/2006 | Eschenbach | 482/52 |
| 2006/0217234 | A1 | 9/2006 | Rodgers, Jr. | |
| 2007/0179023 | A1 * | 8/2007 | Dyer | 482/52 |
| 2007/0219061 | A1 | 9/2007 | Rodgers, Jr. | |

OTHER PUBLICATIONS

U.S. Appl. No. 60/881,205, filed Jan. 19, 2007, Rodgers.

* cited by examiner

TRANSLATING SUPPORT ASSEMBLY SYSTEMS AND METHODS FOR USE THEREOF

CROSS-REFERENCE TO RELATED APPLICATIONS

This application claims priority to U.S. Provisional Patent Application Ser. No. 60/780,599 filed on Mar. 9, 2006 entitled "BELT AND CRANK EXERCISE DEVICE" and Ser. No. 60/881,205 filed on Jan. 19, 2007, entitled "LINKAGE AND BRAKE SYSTEMS", the disclosures of which are hereby incorporated by reference.

TECHNICAL FIELD

The present description relates generally to an exercise device and, more particularly, it relates to an exercise device with a translating support assembly.

BACKGROUND OF THE INVENTION

It can be appreciated that exercise devices have been in use for years and include devices that simulate walking or jogging such as cross country ski machines, elliptic motion machines, and pendulum motion machines. Also included are exercise devices that simulate climbing such as reciprocal stair climbers.

Elliptic motion exercise machines provide inertia that assists in direction change of the pedals, which makes the exercise smooth and comfortable. However, rigid coupling to a crank typically constrains the elliptic path to a fixed length. Therefore, the elliptic path may be too long for shorter users, or too short for tall users. Further, a running stride is typically longer than a walking stride, so a fixed stride length does not ideally simulate all weight bearing exercise activities. Therefore, typical elliptic machines cannot optimally accommodate all users. Some pendulum motion machines may allow variable stride length, but the user's feet typically follow the same arcuate path in both forward and rearward motion. Such a motion does not accurately simulate walking, striding, or jogging, where the user's feet typically lift and lower. Reciprocal stair climbers typically allow the user to simulate a stepping motion, but that motion is generally constrained to a vertically oriented arcuate path defined by a linkage mechanism. Such a motion does not accurately simulate a wide range of real world climbing activities such climbing stairs or climbing sloped terrain.

More recently, variable stride exercise devices utilizing crank systems have been developed. These devices, however, may be complex and have high manufacturing costs.

BRIEF SUMMARY OF THE INVENTION

Various embodiments of the invention relate to exercise devices and methods for use thereof that employ a translating support assembly. In one example, an exercise device includes a frame with a base portion that is supported by the floor. A crank system is coupled to and supported by the frame. Right and left translating support assemblies each have a movable member, a foot support member, and guide elements. Flexible elements couple the crank system to the translating support assembly. Vertical movement of the right and left foot support members applies force to the crank system via the flexible support elements.

An example method for operating an exercise machine according to embodiments includes applying alternating forces to the right and left foot support members, rotating the crank shaft and tracing substantially closed paths with the foot support members.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
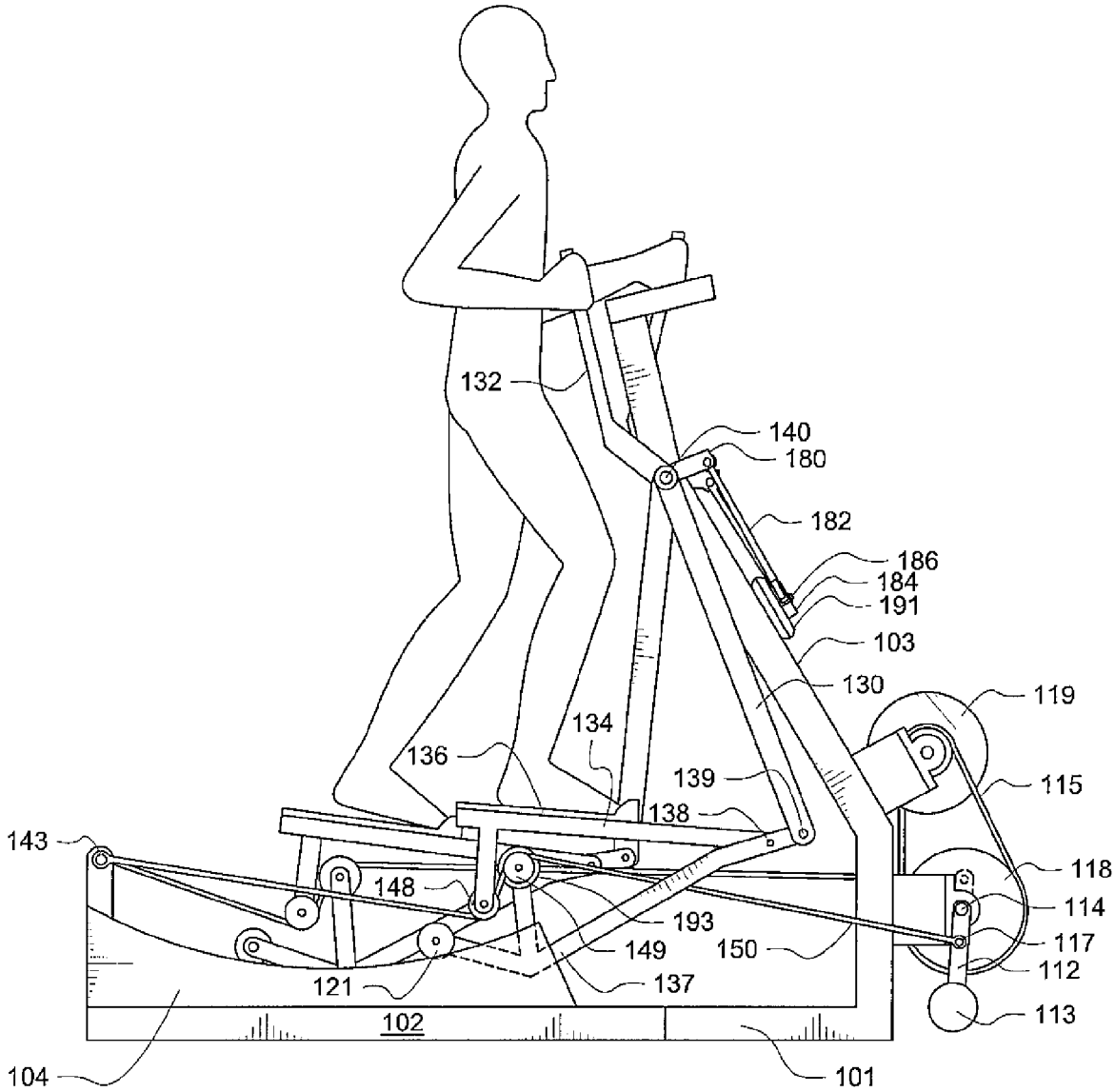
FIG. 1 depicts a side view of an example embodiment of an exercise device adapted according to an embodiment of the invention.
Figure 2:
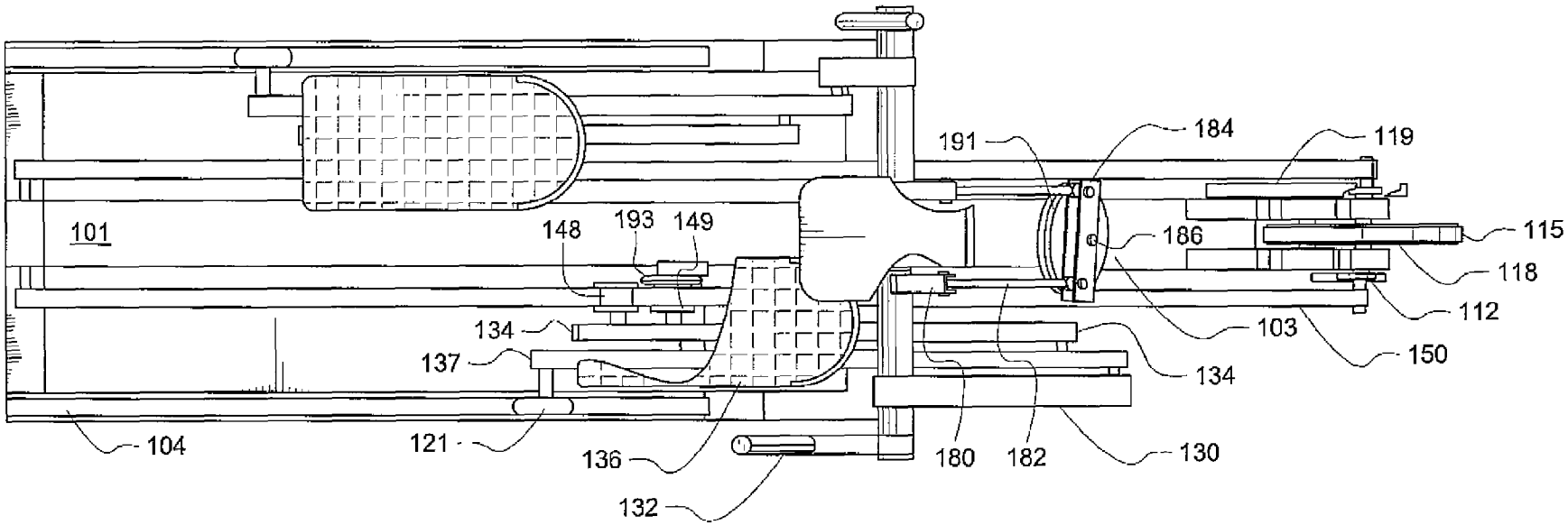
FIG. 2 depicts a top view of an example embodiment of an exercise device adapted according to an embodiment of the invention.

FIG. 1 shows a side view of an embodiment of an exercise device with a translating support assembly. FIG. 2 shows a top view of the embodiment of FIG. 1. Frame 101 includes a basic supporting framework including base 102, upper stalk 103, and track section 104, which is curved in this embodiment. The lower portion of base 102 engages and is supported by the floor. The crank system includes crank arms 112 attached to crank shaft 114. Although only one crank arm is shown, it is understood that there is an opposing crank arm in this example. Each crank arm 112 is coupled to its respective flexible element 150 at a crank coupling location 117. Crank shaft 114 is supported by frame 101 so that crank shaft 114 rotates about its longitudinal axis. One or both of crank arms 112 may include a counterweight, such as weight 113.

Although the embodiment shown in FIG. 1 utilizes a crank shaft with crank arms, other crank system configurations can be utilized. For example, some crank systems may have more than two crank arms. Still other crank systems may forego crank arms and utilize a ring supported and positioned by rollers with crank coupling locations at or near the periphery of the ring. In fact, any kind of crank system now known or later developed may be used in various embodiments In this example, the crank system also includes brake/inertia device 119 coupled to crank shaft 114 through belt 115 and pulley 118. In other embodiments a brake inertia device may be coupled directly to crank shaft 114. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation. Although the embodiment shown in FIG. 1 uses a single brake/inertia device, it is possible to utilize multiple brake/inertia devices or to separate the braking and inertia functions between two or more devices. Further, although the embodiment of FIG. 1 shows the crank system and brake system located at the front of frame 101, it is possible to place the crank system at other locations such as at the rear of frame 101.

The translating support assembly of FIG. 1 includes foot support member 134, movable member 137, arcuate motion member 130, and guide elements 148 and 149. Although only the elements of the right side translating support assembly are numbered, it is understood that there is a left side translating support assembly with comparable elements.

In the context of this specification, the term "member" includes a structure or link of various sizes, shapes, and forms. For example, a member may be straight, curved, or a combination of both. A member may be a single component or a combination of components coupled to one another. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to movable member 137 at coupling location 138. Coupling may be accomplished with a pivotal pin connection as shown in FIG. 1, but coupling may also be accomplished with any device that allows relative rotation between the arcuate motion member 130 and foot support member 134.

As used herein, the term "coupling" or "coupled" includes a direct coupling or an indirect coupling. Movable member 137 is coupled to arcuate motion member 130 at location 139 and thereby also couples foot support member 134 to arcuate motion member 130. Coupling of movable member 137 to arcuate motion member 130 may be accomplished with shaft and bushing as shown in FIG. 1, but coupling may also be accomplished with any device that allows rotation of movable member 137 relative to arcuate motion member 130. Moveable member 137 is at least partially supported by roller 121 that engages track 104. Movable member 137 may be straight, curved, or bent. Arcuate motion member 130 is coupled to frame 101 at coupling location 140. Coupling may be accomplished with shaft and bushing as shown in FIG. 1, but coupling may also be accomplished with any device that allows rotation of arcuate motion member 130 relative to frame 101. Guide element 148 is coupled to foot support member 134 and guide element 149 is coupled to movable member 137.

As shown in FIG. 1, the portion of arcuate motion member 130 coupled to frame 101 is above the portion of arcuate motion member 130 coupled to foot support member 134. In the context of this specification, one element is "above" another element if it is higher than the other element. The term "above" does not require that an element or part of an element be directly over another element. Conversely, in the context of this specification, one element is "below" another element if it is lower than the other element. The term "below" does not require that an element or part of an element be directly under another element.

Flexible element 150 is coupled at one end to crank arm 112 at crank coupling location 117 and at its other end to frame 101 at location 143. Between its ends, flexible element 150 engages guide element 149 located on movable member 137 and guide element 148 located on foot support member 134. Guide elements 148 and 149 as shown in FIG. 1 are pulleys, but they may be any other component that can guide or support a flexible element such as a cog belt pulley, a sprocket, a roller, or a slide block. Flexible element 150 may be a belt, a cog belt, a chain, a cable, or any flexible component able to carry tension. Flexible element 150 may have some compliance in tension, such as a rubber belt, or it may have little compliance in tension, such as a chain.

Although the embodiment of FIG. 1 and the other figures in this specification show only one guide element on movable member 137 and one guide element on foot support member 134, it is possible to use multiple guide elements on a foot member and/or a movable member. As an example, movable member 137 may be configured with two guide elements so that the first guide element would be located ahead and the second guide element would be located behind foot member guide element 148. As an alternate example, foot support member 134 could be configured with two guide elements so that the first guide element would be located ahead and the second guide element would be located behind movable member guide element 149. Further, guide elements could be placed on frame 101 to route flexible element 150 in ways other than that shown in FIG. 1

Figure 3A:
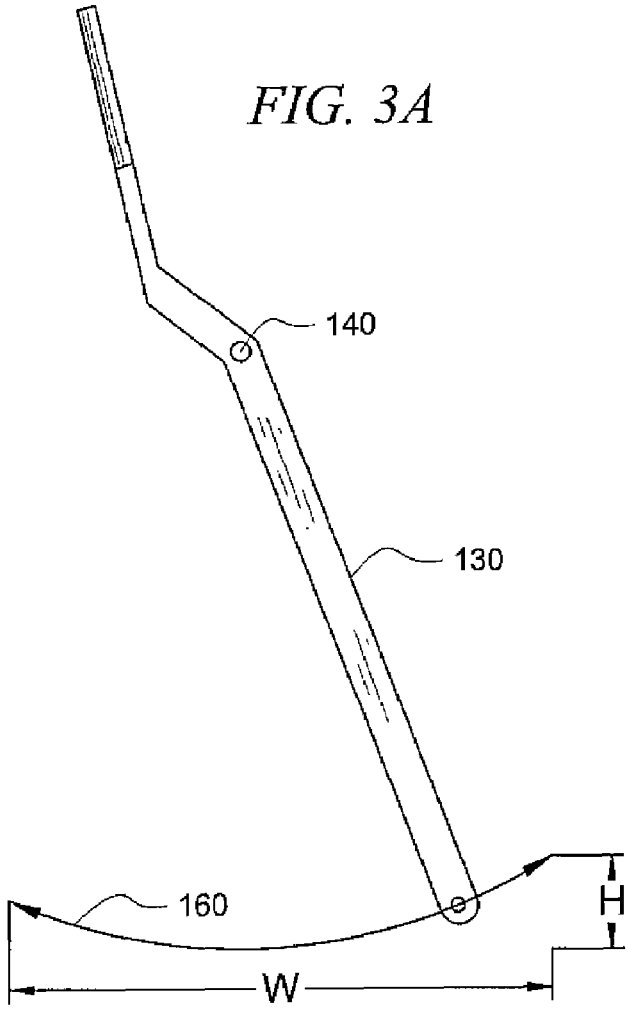
FIG. 3A depicts an example embodiment of an arcuate motion member path.

Arcuate motion member 130 may be oriented in a generally vertical position. In the context of this specification, an element is oriented in a "generally vertical" position if the element, as measured with respect to its connection points to other elements of the system considered within the range of motion for the element, tends to be closer to vertical than horizontal. FIG. 3A shows an example of an arcuate motion member that is oriented in a generally vertical position. The frame of reference is fixed relative to coupling location 140. As arcuate motion member 130 moves through its range of motion about coupling location 140, coupling location 138 describes an arcuate path 160. If the width W of arcuate path 160 is greater than its height H, the arcuate motion member 130 is considered to be in a generally vertical position. It is not necessary that arcuate motion member 130 be straight, nor is it necessary that any portion be exactly vertical. Further, it is not necessary that the member be closer to vertical than horizontal at every moment during its use.

Figure 3B:
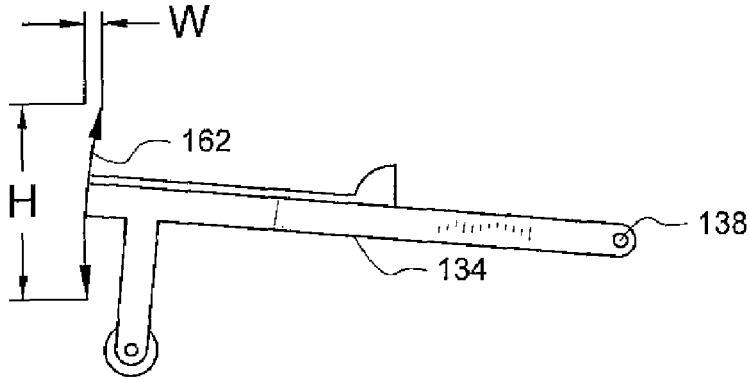
FIG. 3B depicts an example embodiment of a foot support member path.

Foot support member 134 may be oriented in a generally horizontal position. In the context of this specification, an element is oriented in a "generally horizontal" position if the element, as measured with respect to its connection points to other elements of the system considered within the range of motion for the element, tends to be closer to horizontal than vertical. FIG. 3B shows an example of a foot support member that is oriented in a generally horizontal position. The frame of reference is fixed relative to coupling location 138. As foot support member 134 moves through its range of motion about coupling location 138, it describes an arcuate path 162. If the height H of arcuate path 162 is greater than its width W, the foot support member is in a generally vertical position. It is not necessary that foot support member 134 be straight, nor is it necessary that any portion be exactly horizontal. Further, it is not necessary that the member be closer to horizontal than vertical at every moment during its use.

During operation, the user ascends the exercise device, stands on foot plates 136, and initiates an exercising motion by placing his/her weight on one or more of foot plates 136. As the user steps downward, force is transmitted to flexible support element 150 by guide element 148. In turn, flexible element 150 causes rotation of crank shaft 114 and brake/inertia device 119. As crank shaft 114 continues to rotate, the distance between crank coupling location 117 on crank 112 and the coupling point 143 on frame 101 continuously changes. This continuous change in the distance described above results in a continuous alternating lifting and lowering motion of foot plate 136. This lifting and lowering motion simulates the lifting and lowering motion that a user's foot may undertake during walking, striding, jogging, and climbing. As each foot plate 136 continuously lifts and lowers, the user may simultaneously undertake a striding motion by applying a forward or rearward force to foot plates 136. This striding motion results in displacement of foot plates 136, foot members 134, movable members 137, and guide elements 148 and 149. The combination of displacement of the foot plates 136 by the user and the continuous lifting and lowering motion of foot plates 136 results in a substantially closed path that is traced by each foot support member 134.

During use of the machine, the path traced can be referred to as a "substantially closed path." In other words, while it is generally rare for a user's exercise path to meet up at its exact beginning (thereby tracing a truly closed path), a user's path over time can be expected to trace a set of approximately repeated curves, resulting in a recognizable, curved path. Some paths may be egg-shaped, somewhat elliptical, saddle shaped (lower in the middle than at the ends of the horizontal extent), or the like.

The length of the path is instantaneously controlled by the user according to the amount of forward or rearward force applied to foot plates 136. If the user applies little rearward or forward force, the exercise path may be nearly vertical in orientation with little or no horizontal amplitude. Alternately, if the user applies significant rearward or forward force, the exercise path may have significant horizontal amplitude. Alternating weight transfer during exercise from one foot plate to the opposing foot plate transmits force to the crank 112 which sustains rotation of crank 112, crank shaft 114, and brake/inertia device 119.

Track section 104 may be curved as shown in FIG. 1. In some embodiments, section 104 is a separate curved section coupled to frame 101, though a curved section integral to the frame may provide the same function. Such curvature provides a restoring force that tends to restore the translating support assembly to a neutral position when the user applies weight to foot plate 136. Handles 132 may move in an arcuate pattern and may be grasped by the user. If the user were to stand stationary on foot plates 136 for an extended period of time, a simple unweighted crank system might settle into a locked "top dead center" position. However, the inclusion of counterweight 113 in the crank system applies a downward force to offset the crank system from the "top dead center" position.

Some embodiments include cross-coupling. For instance, in this example, the right and left side translating support assemblies are cross coupled through the left and right arcuate motion members so that the right and left foot plates 136 move in opposition. Elements 180 are coupled to arcuate motion members 130. Thus, each of right and left elements 180 moves in unison with each right and left arcuate motion member 130, respectively. Connectors 182 couple right and left elements 180 to the right and left sides of rocker arm 184. Rocker arm 184 is pivotally coupled at its mid portion to frame 101 at location 186. As arcuate motion members 130 move, connectors 182 cause a rocking motion of rocker arm 184. This rocking motion causes right and left arcuate motion members 130 to move in opposition thus cross coupling the right and left pivotal linkage assemblies.

Additional braking systems may be included in the exercise device to resist horizontal movement of the foot plates. The embodiment of FIG. 1 has two such braking systems. Brake 191 is coupled to the frame 101 and the rocker arm 184. The brake resists motion of rocker arm 184 which in turn resists motion of arcuate member 130, foot member 134, and foot plate 136. Brake 191 (and/or device 119) may be of several types such as frictional, electromagnetic, or fluidic. Rather than direct coupling of brake 191 to rocker arm 184, brake 191 can be indirectly coupled to rocker arm 184 through a belt and pulley system. Brake 193 is coupled to the movable member 134 and pulley guide element 149. The brake resists rotary motion of pulley guide element 149 which provides resistance to motion of the movable member 137, foot member 134, and foot plate 136.

Figure 4:
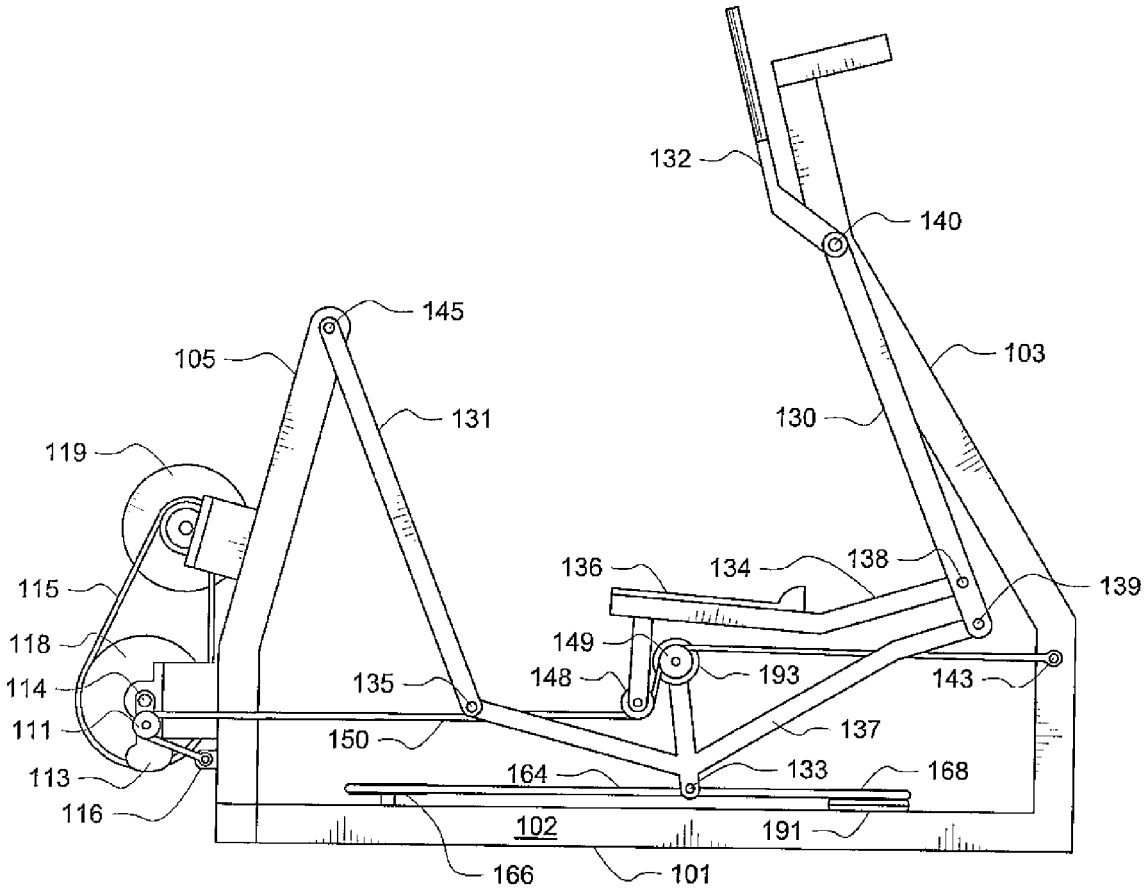
FIG. 4 depicts a side view of an example embodiment of an exercise device adapted according to an embodiment of the invention.

FIG. 4 shows a side view of another embodiment. This embodiment has many elements that correspond to elements of the embodiments in FIGS. 1 and 2 (though they may have somewhat different shapes and/or dimensions), and those elements are numbered in the same manner. This embodiment demonstrates, for example, that a foot support member may be coupled to an arcuate motion member, that translating support assemblies may be cross coupled with a continuous belt loop, that a movable member may be support by a link, that the crank system may be located at the rear of the machine, and that the flexible element may not be attached directly to the crank. FIG. 4 omits most of the left side elements of the embodiment for visual clarity, but it is understood that there are left side elements comparable to the right side elements.

Frame 101 includes a basic supporting framework including base 102, upper stalk 103, and vertical support 105. The crank system includes crank arms 112 attached to crank shaft 114. Crank shaft 114 is supported by frame 101 so that crank shaft 114 rotates about its longitudinal axis. One or both of crank arms 112 may include a counterweight, such as weight 113.

The crank system may also include brake/inertia device, such as device 119, coupled to crank shaft 114 through belt 115 and pulley 118. Alternately, a brake inertia device may be coupled directly to crank shaft 114. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation. The crank system of the embodiment of FIG. 4 is located at the rear of the machine, and this location can be used for the crank systems in other embodiments of this specification.

The translating support assembly of this embodiment includes foot support member 134, movable member 137, arcuate motion member 130, support link 131, and guide elements 148 and 149. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Movable member 137 is coupled to arcuate motion member 130 at location 139. Moveable member 137 is coupled to support link 131 at location 135. Support link 131 is coupled to vertical support 105 at location 145. Movable member 137 may be straight, curved, or bent. Arcuate motion member 130 is coupled to frame 101 at coupling location 140. Guide element 148 is coupled to foot support member 134 and guide element 149 is coupled to movable member 137.

Flexible element 150 is coupled at one end to upper stalk 103 at location 143 and at its other end to vertical support 105 at location 116. Between its ends, flexible element 150 engages guide element 149 located on movable member 137, guide element 148 located on foot member 134, and guide element 111 located on crank 112. Note that the use of guide element 111 results in coupling of the flexible element to crank 112 and that this coupling method can be used in other embodiments of the invention.

During operation, the user ascends the exercise device, stands on foot plates 136, and initiates an exercising motion by placing his/her weight on one or more of foot plates 136. As the user steps downward, force is transmitted to flexible support element 150 by guide element 148. In turn, flexible element 150 causes rotation of crank shaft 114 and brake/inertia device 119. As crank shaft 114 continues to rotate, the distance between the crank system coupling location (i.e., the portion of guide element 111 that engages flexible element 150) and frame coupling point 143 continuously changes. This continuous change in the distance described above results in a continuous alternating lifting and lowering motion of foot plate 136. This lifting and lowering motion simulates the lifting and lowering motion that a user's foot may undertake during walking, striding, jogging, and climbing. As each foot plate 136 continuously lifts and lowers, the user may simultaneously undertake a striding motion by applying a forward or rearward force to foot plates 136. This striding motion results in displacement of foot plates 136, foot members 134, movable members 137, and guide elements 148 and 149. The combination of displacement of the foot plates 136 by the user and the continuously lifting and lowering motion of foot plates 136 results in a substantially closed path. Supporting link 131 may be oriented in a generally vertical position. Such an orientation provides a restoring force that tends to restore the translating support assembly to a neutral position when the user applies weight to foot plate 136.

As in the embodiment of FIG. 1 and FIG. 2, the right and left side translating support assemblies are cross coupled. The embodiment of FIG. 4 demonstrates that a cross coupling system may use a continuous belt loop. The cross coupling system includes continuous belt 164. Continuous belt 164 engages pulleys 166 and 168. Continuous belt 164 is coupled to movable members 137 at coupling locations 133. Although only the right side movable member is shown, it is understood that there is a comparable left side movable member and that the continuous belt 164 is coupled to the left side movable member. As one movable member moves forward, the opposing movable member moves rearward. Continuous belt 164 may have a slight amount of compliance that allows it to accommodate the varying geometry of the system as movable members 137 move forward and rearward. This continuous belt loop cross coupling system may be used in other embodiments of the invention. Similarly, the rocker arm cross coupling system of the embodiment of FIG. 1 and FIG. 2 may be substituted in the embodiment of FIG. 4. In fact, any cross coupling system now known or later developed may be used in various embodiments.

As in the FIG. 1 and FIG. 2 embodiments, additional braking systems may be included to resist horizontal movement of foot plates 136. Brake 191 is coupled to pulley 168 and frame 101, and brake 191 creates resistance to rotary motion of pulley 168.

Figure 5:
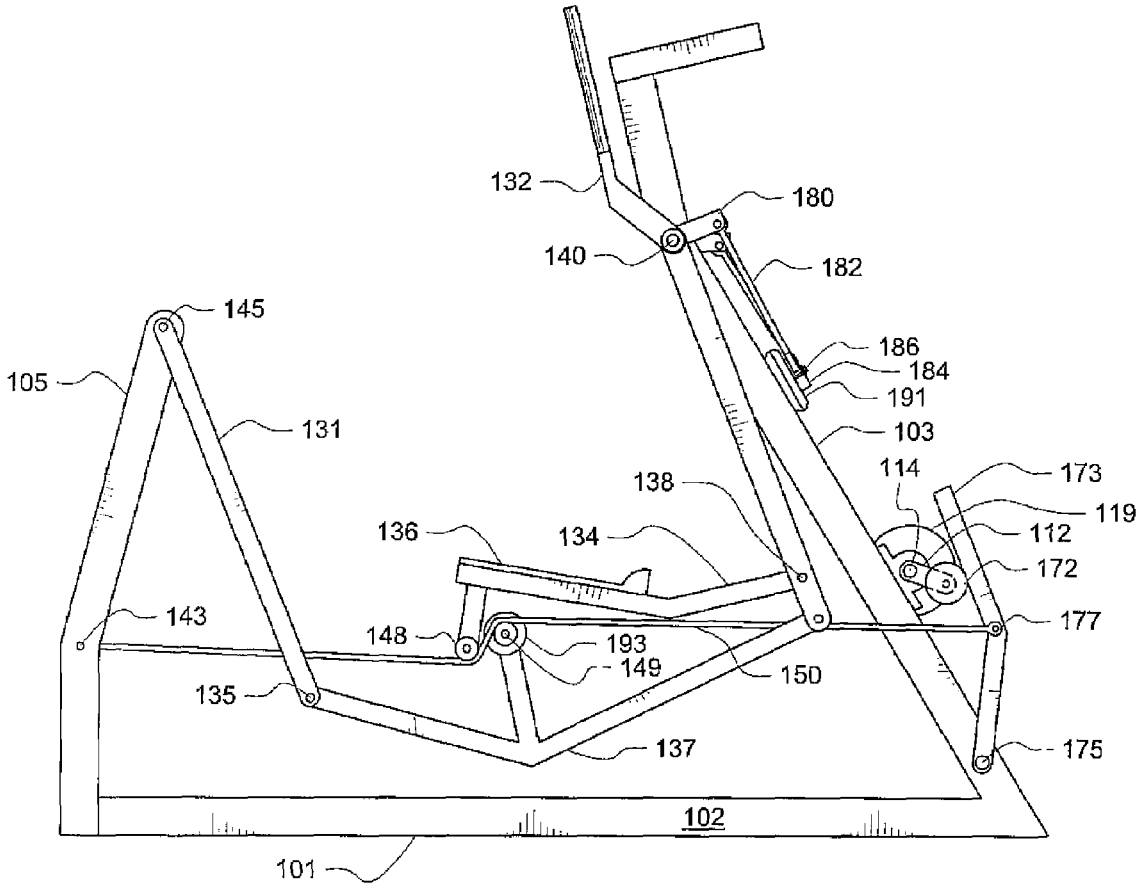
FIG. 5 depicts a side view of an example embodiment of an exercise device adapted according to an embodiment of the invention.

FIG. 5 shows a side view of another embodiment. This embodiment has many elements that correspond to elements of the embodiments in FIG. 1,2 and 4 (though they may have somewhat different shapes and/or dimensions), and those elements are numbered in the same manner. This embodiment demonstrates, for example, that an intermediate linkage assembly may be used to couple the crank system to the flexible element. FIG. 5 omits most of the left side elements of the embodiment for visual clarity, but it is understood that there are left side elements comparable to the right side elements.

Frame 101 includes a basic supporting framework including base 102, upper stalk 103, and vertical support 105. The lower portion of base 102 engages and is supported by the floor. The crank system includes crank arms 112 attached to crank shaft 114. Crank shaft 114 is supported by frame 101 so that crank shaft 114 rotates about its longitudinal axis. Though not shown in this embodiment, one or both of crank arms 112 may include a counterweight, such as weight 113.

The crank system may also include a brake/inertia device, such as device 119, coupled to the crank shaft through belt 115 and pulley 118. Alternately, a brake inertia device may be coupled directly to the crank shaft. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation.

An intermediate linkage assembly is coupled to the crank system. In this example it includes actuating link 173 and engagement roller 172. Actuating link 173 is coupled to frame 101 at location 175 and is coupled to crank 112 through engagement roller 172.

A translating support assembly may include foot support member 134, movable member 137, arcuate motion member 130, support link 131, and guide elements 148 and 149. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Movable member 137 is coupled to arcuate motion member 130 at location 139. Moveable member 137 is coupled to support link 131 at location 135. Support link 131 is coupled to vertical support 105 at location 145. Movable member 137 may be straight, curved, or bent. Arcuate motion member 130 is coupled to frame 101 at coupling location 140. Guide element 148 is coupled to foot support member 134 and guide element 149 is coupled to movable member 137.

Flexible element 150 is coupled at one end to vertical support 105 at location 143 and at its other end to actuating link 173 at location 177. Between its ends, flexible element 150 engages guide element 149 located on movable member 137 and guide element 148 located on foot member 134.

During operation, the user ascends the exercise device, stands on foot plates 136, and initiates an exercising motion by placing his/her weight on one or more of foot plates 136. As the user steps downward, force is transmitted to flexible support element 150 by guide element 148. In turn, flexible element 150 causes movement of actuating link 173. Movement of actuating link 173 causes rotation of crank 112, crank shaft 114, and brake/inertia device 119. As crank shaft 114 continues to rotate, the distance between coupling point 177 on actuating member 173 and coupling point 143 on vertical support 105 continuously changes. This continuous change in the distance described above results in a continuous alternating lifting and lowering motion of foot plate 136. This lifting and lowering motion simulates the lifting and lowering motion that a user's foot may undertake during walking, striding, jogging, and climbing. As each foot plate 136 continuously lifts and lowers, the user may simultaneously undertake a striding motion by applying a forward or rearward force to foot plates 136. This striding motion results in displacement of foot plates 136, foot members 134, movable members 137, and guide elements 148 and 149. The combination of displacement of the foot plates 136 by the user and the continuously lifting and lowering motion of foot plates 136 results in a substantially closed path. Supporting link 131 may be oriented in a generally vertical position. Such an orientation provides a restoring force that tends to restore the translating support assembly to a neutral position when the user applies weight to foot plate 136.

As in the FIG. 1, FIG. 2, and FIG. 4 embodiments, the right and left side pivotal linkage assemblies may be cross coupled so that the right and left foot plates 136 move in opposition. Also as in FIG. 1, FIG. 2, and FIG. 4 embodiments, additional braking systems may be included to resist horizontal movement of the foot plates.

Figure 6:
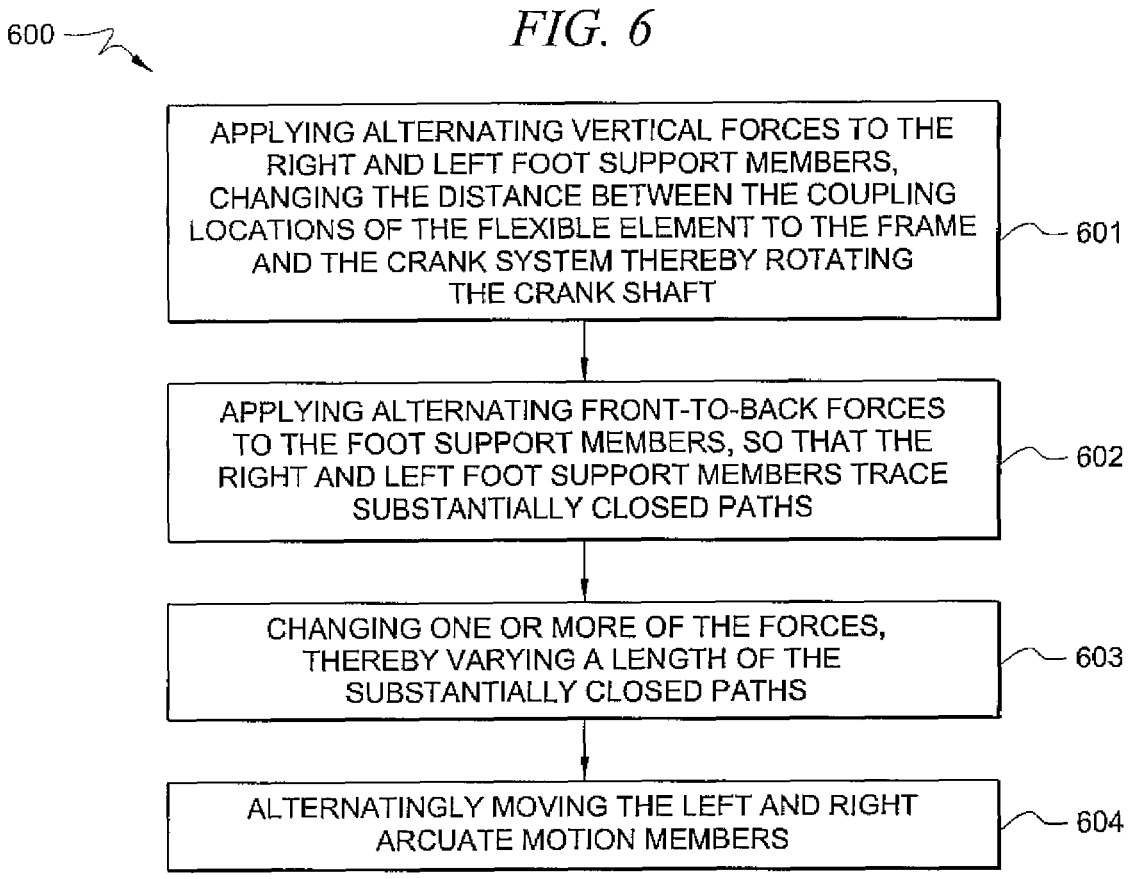
FIG. 6 depicts an example method for using a machine adapted according to an embodiment of the invention.

FIG. 6 is an illustration of exemplary method 600 adapted according to an embodiment of the invention. Method 600 may be performed, for example, by a user of a system, such as that shown in FIGS. 1, 2, 4, and 5.

In step 601, alternating vertical forces are applied to the right and left foot support members, changing the distance between the coupling locations of the flexible element to the frame and the crank system thereby rotating the crank shaft. Similarly, in step 602, alternating front-to-back forces are applied to the foot support members, so that the right and left foot support members trace substantially closed paths.

In step 603, one or more of the forces are changed, thereby varying a length of the substantially closed paths. Some embodiments include arcuate motion members for a user to grasp and to make forward and backward motions therewith. In such embodiments, step 604 includes alternatingly moving the left and right arcuate motion members.

Method 600 is shown as a series of discrete steps. However, other embodiments of the invention may add, delete, repeat modify and/or rearrange various portions of method 600. For example, steps 601-604 may be performed continuously for a period of time. Further, steps 601-604 will generally be performed simultaneously during the user's striding motion.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An exercise apparatus comprising:

a frame having first and second laterally-spaced ends and having right and left flexible element coupling locations, the flexible element coupling locations proximate said first end of the frame;

a crank system comprising a rotational axis and first and second crank coupling locations radially displaced from said rotational axis, the crank system being supported by the frame proximate the second end of the frame;

a right translating support assembly comprising a right foot support member, a right moveable member, and a right arcuate motion member, said right foot support member comprising a first right guide element, said right moveable member comprising a second right guide element located above the first right guide element at least a portion of the time during use, said right arcuate motion member pivotally coupled to the frame;

a left translating support assembly comprising a left foot support member, a left moveable member, and a left arcuate motion member, said left foot support member comprising a first left guide element, said left moveable member comprising a second left guide element located above the first left guide element at least a portion of the time during use, said left arcuate motion member pivotally coupled to the frame;

a right flexible support system comprising a right flexible element, the right flexible element coupled to the crank system at the first crank coupling location, coupled to the frame at the right flexible element coupling location, and engaging the first and second right guide elements, said right flexible element configured to carry tension while at least partially wrapping around the first and second right guide elements, said first and second right guide elements configured to allow the right flexible element to translate across the first and second right guide elements during use, said right flexible support system operative to sustain rotation of the crank system when a user undertakes an exercise motion having nearly vertical orientation; and a left flexible support system comprising a left flexible element, the left flexible element coupled to the crank system at the second crank coupling location, coupled to the frame at the left flexible element coupling location, and engaging the first and second left guide elements, said left flexible element configured to carry tension while at least partially wrapping around the first and second left guide elements, said first and second left guide elements configured to allow the left flexible element to translate across the first and second left guide elements during use, said left flexible support system operative to sustain rotation of the crank system when a user undertakes an exercise motion having nearly vertical orientation;

wherein force applied to the right and left foot support members permits varying among a climbing motion and a closed path walking, striding, or jogging motion, the length of the walking, striding, or jogging motion being instantaneously variable by varying a forward and rearward force applied to the foot support members.

2. The exercise apparatus of claim 1, wherein the crank system is associated with a brake device providing resistance to rotation of the crank system.

3. The exercise apparatus of claim 1, wherein the crank system is associated with an inertia device that stores and delivers energy during rotation of the crank system.

4. The exercise apparatus of claim 1 wherein the right arcuate motion member is pivotally coupled to the right moveable member and the right foot support member, and the left arcuate motion member is pivotally coupled to the left moveable member and the left foot support member.

5. The exercise apparatus of claim 1, wherein the left and right translating support assemblies are cross-coupled by a cross coupling system to provide alternating motion.

6. The exercise apparatus of claim 5, wherein said cross coupling system is coupled to a brake to resist forward and rearward motion of the right and left foot support members.

7. The exercise apparatus of claim 5, wherein the cross-coupling is provided by a belt system coupled to the right and left moveable members.

8. The exercise apparatus of claim 5, wherein the cross-coupling is provided by a rocker mechanism coupled to the right and left moveable members.

9. The exercise apparatus of claim 1, the right arcuate motion member comprising:

a first handle portion; and the left arcuate motion member comprising a second handle portion.

10. The exercise apparatus of claim 1, further comprising:

a right curved track section supporting the right moveable member; and a left curved track section supporting the left moveable member.

11. The exercise apparatus of claim 10 wherein the right and left curved track sections are portions of the frame.

12. The exercise apparatus of claim 1, further comprising:

a first support link coupling the right moveable member to the frame; and a second support link coupling the left moveable member to the frame.

13. The exercise apparatus of claim 1, wherein the crank system is mounted near the end of the apparatus faced by the user during exercise.

14. The exercise apparatus of claim 1, wherein the crank system is mounted near the rear of the apparatus.

15. The exercise apparatus of claim 1, wherein the crank system is coupled to the flexible elements using an intermediate linkage system.

16. The exercise apparatus of claim 1, wherein the crank system comprises:

right and left pulley elements coupling the crank system to the flexible elements.

17. The exercise apparatus of claim 1 wherein the crank system comprises a counterweight.

18. The exercise apparatus of claim 1, wherein a first brake resists motion of the crank system, and wherein a second brake resists motion of at least one of the foot support members.

19. An exercise apparatus comprising:

a frame having first and second laterally-spaced ends and having right and left flexible element coupling locations, the flexible element coupling locations proximate said first end of the frame;

a crank system with a rotational axis and right and left crank coupling locations radially displaced from said rotational axis, the crank system supported by the frame proximate the second end of the frame;

a right foot support member comprising a first right guide element;

a left foot support member comprising a first left guide element;

a right movable member comprising a second right guide element;

a left movable member comprising a second left guide element;

a right flexible element coupled to the frame at the right flexible element coupling location and to the crank system at the right crank coupling location and directly contacting the first and second right guide elements, said right flexible element configured to carry tension and to flex around the first and second right guide elements, said first and second right guide elements configured to allow the right flexible element to move across said first and second right guide elements while contacting said first and second right guide elements;

a left flexible element coupled to the frame at the left flexible element coupling location and to the crank system at the left crank coupling location and directly contacting the first and second left guide elements, said left flexible element configured to carry tension and to flex around the first and second left guide elements, said first and second left guide elements configured to allow the left flexible element to move across said first and second left guide elements while contacting said first and second left guide elements;

a right arcuate motion member pivotally coupled to the frame and coupled to the right movable member and the right foot support member; and a left arcuate motion member pivotally coupled to the frame and coupled to the left movable member and the left foot support member;

wherein an exercise motion having nearly vertical orientation sustains rotation of the crank system; and wherein alternating forces applied to the right and left foot support members during a climbing, walking, striding, or jogging motion continuously changes the distance between the right crank coupling location and the right flexible element coupling location and continuously changes the distance between the left crank coupling location and the left flexible element coupling location, the length of the walking, striding, or jogging motion being instantaneously variable by varying forward and rearward forces applied to the foot support members; and wherein the right foot support member provides motion to the right arcuate motion member.

20. The exercise apparatus of claim 19, wherein the crank system is associated with a brake device providing resistance to rotation of the crank system.

21. The exercise apparatus of claim 19, wherein the crank system is associated with an inertia device that stores and delivers energy during rotation of the crank system.

22. The exercise apparatus of claim 19, wherein the left and right arcuate motion members, the left and right foot support members, and the left and right movable members form a translating support assembly wherein the respective left and right sides are cross-coupled by a cross coupling system to provide alternating motion.

23. The exercise apparatus of claim 22, wherein said cross coupling system is coupled to a brake.

24. The exercise apparatus of claim 22, wherein the cross-coupling is provided by a belt system coupled to the right and left moveable members.

25. The exercise apparatus of claim 22, wherein the cross-coupling is provided by a rocker mechanism coupled to the right and left moveable members.

26. The exercise apparatus of claim 19, the right arcuate motion member comprising:

a first handle portion; and the left arcuate motion member comprising a second handle portion.

27. The exercise apparatus of claim 19, further comprising:

a first support link coupling the right moveable member to the frame; and a second support link coupling the left moveable member to the frame.

28. The exercise apparatus of claim 19, wherein the crank system is mounted near the end of the apparatus faced by the user during exercise.

29. The exercise apparatus of claim 19 wherein the crank system is mounted near the rear of the apparatus.

30. The exercise apparatus of claim 19, wherein the crank system is coupled to the flexible elements using an intermediate linkage system.

31. The exercise apparatus of claim 19, wherein the crank system comprises:

right and left guide elements coupling the crank system to the flexible elements.

32. The exercise apparatus of claim 19, wherein the crank system comprises a counterweight.

33. The exercise apparatus of claim 19, wherein a first brake resists motion of the crank system, and wherein a second brake resists motion of at least one of the foot support members.

34. An exercise apparatus comprising:

a frame having first and second laterally-spaced ends and having right and left flexible element coupling locations, the flexible element coupling locations proximate said first end of the frame;

a crank system with a rotational axis and right and left crank coupling locations radially displaced from said rotational axis, the crank system supported by the frame proximate the second end of the frame;

a right foot support member comprising a first right guide element;

a left foot support member comprising a first left guide element;

a right movable member comprising a second right guide element;

a left movable member comprising a second left guide element;

a right flexible element coupled to the frame at the right flexible element coupling location and to the crank system at the right crank coupling location and directly contacting the first and second right guide elements, said right flexible element configured to carry tension and to flex around the first and second right guide elements, said first and second right guide elements configured to allow the right flexible element to move across said first and second right guide elements while contacting said first and second right guide elements;

a left flexible element coupled to the frame at the left flexible element coupling location and to the crank system at the left crank coupling location and directly contacting the first and second left guide elements, said left flexible element configured to carry tension and to flex around the first and second left guide elements, said first and second left guide elements configured to allow the left flexible element to move across said first and second left guide elements while contacting said first and second left guide elements;

a right curved track section supporting the right moveable member; and a left curved track section supporting the left moveable member;

wherein an exercise motion having nearly vertical orientation sustains rotation of the crank system; and wherein alternating forces applied to the right and left foot support members during a climbing, walking, striding, or jogging motion continuously changes the distance between the right crank coupling location and the right flexible element coupling location and continuously changes the distance between the left crank coupling location and the left flexible element coupling location, the length of the walking, striding, or jogging motion being instantaneously variable by varying forward and rearward forces applied to the foot support members.

35. The exercise apparatus of claim 34 wherein the right and left curved track sections are portions of the frame.

* * * * *